US009612083B2

(12) United States Patent
Cottle et al.

(10) Patent No.: US 9,612,083 B2
(45) Date of Patent: Apr. 4, 2017

(54) ADJUSTABLE LENGTH SLIDE-ACTION RIFLE STOCK

(71) Applicant: Slide Fire Solutions, LP, Moran, TX (US)

(72) Inventors: Jeremiah Cottle, Moran, TX (US); Edmund R. Retort, Edinburg, PA (US); Christopher Taylor Nichols, Cisco, TX (US); Martin F. Anness, Poland, OH (US)

(73) Assignee: Slide Fire Solutions LP, Moran, TX (US)

( * ) Notice: Subject to any disclaimer, the term of this patent is extended or adjusted under 35 U.S.C. 154(b) by 0 days.

(21) Appl. No.: 14/986,280

(22) Filed: Dec. 31, 2015

(65) Prior Publication Data

US 2016/0187099 A1 Jun. 30, 2016

Related U.S. Application Data

(60) Provisional application No. 62/098,850, filed on Dec. 31, 2014.

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/10; F41C 23/20; F41C 23/06
USPC ..... 42/73, 71.01, 75.01
See application file for complete search history.

(56) References Cited

U.S. PATENT DOCUMENTS

| | | | |
|---|---|---|---|
| 554,068 | A | 2/1896 | Kimball |
| 981,210 | A | 1/1911 | Menteyne et al. |
| 1,447,861 | A | 3/1923 | Johnston |
| 1,587,009 | A | 1/1926 | Bobbe |

(Continued)

FOREIGN PATENT DOCUMENTS

WO 2012050670 A2 4/2012

OTHER PUBLICATIONS

"[Archived Thread]—My Akins Accelerated 10/22 can kick your 10/22 ass . . . " Purported internet discussion thread. Aug. 13-22, 2006. (Copyright); Relevant pages may include p. 3 of 5. [http://www.ar15.com/forums/t_6_11/203814_.html].

(Continued)

*Primary Examiner* — Joshua Freeman
(74) *Attorney, Agent, or Firm* — Endurance Law Group, PLC

(57) ABSTRACT

A manually-actuated slide-action handle (22) for a semi-automatic firearm. The handle has a chassis portion (58) and a length-adjustable shoulder stock portion (60) to enable a user to alter the trigger pull length of the firearm. A finger rest (82) stabilizes the end of a user's trigger finger stretched in front of the firearm trigger. The finger rest is detachable from the chassis and has a generally U-shaped configuration that is adapted to connect to the handle in either a right-handed position or an inverted left-handed position. A lock switch (116) is located on the grip base of a pistol grip feature (66) to selectively arrest relative sliding movement between the firing unit and the handle. A brake (76) is controlled by an engagement lever to selectively remove play between the handle and the firing unit portion of the firearm for competitive slow shooting.

20 Claims, 11 Drawing Sheets

(56) References Cited

U.S. PATENT DOCUMENTS

| | | | | |
|---|---|---|---|---|
| 1,587,003 | A | 6/1926 | Kewish | |
| 2,220,663 | A | 11/1940 | Rossmanith | |
| 2,270,707 | A | 1/1942 | Humski | |
| 2,361,985 | A | 11/1944 | Birkigt | |
| 2,465,487 | A | 3/1949 | Sampson et al. | |
| 2,465,587 | A | 3/1949 | Sampson et al. | |
| 2,491,492 | A | 12/1949 | Gaidos | |
| 2,874,502 | A | 2/1959 | Lockwood | |
| 2,970,398 | A | 2/1961 | Crouch | |
| 3,031,786 | A | 5/1962 | Robert | |
| 3,348,328 | A | 10/1967 | Roy | |
| 3,507,067 | A | 4/1970 | Into | |
| 3,683,535 | A * | 8/1972 | Lewis | F41C 23/10 42/71.02 |
| 3,731,588 | A | 5/1973 | Curtis et al. | |
| 3,785,243 | A | 1/1974 | Christakos | |
| 4,002,101 | A | 1/1977 | Tellie | |
| 4,344,351 | A | 8/1982 | Mcqueen | |
| 4,532,852 | A | 8/1985 | Hance et al. | |
| 4,553,468 | A | 11/1985 | Castellano et al. | |
| 4,579,037 | A | 4/1986 | Gillum | |
| 4,601,123 | A | 7/1986 | Swearengen et al. | |
| 4,787,288 | A | 11/1988 | Miller | |
| 4,803,910 | A | 2/1989 | Troncoso | |
| 4,823,671 | A | 4/1989 | Buryta | |
| 5,074,190 | A | 12/1991 | Troncoso | |
| 5,092,052 | A | 3/1992 | Godsey | |
| 5,433,134 | A | 7/1995 | Leiter | |
| 5,560,136 | A * | 10/1996 | Cupp | F41C 23/10 42/71.02 |
| 5,630,406 | A | 5/1997 | Dumont | |
| 5,726,377 | A | 3/1998 | Harris et al. | |
| 5,780,762 | A | 7/1998 | Kobayashi | |
| 5,852,891 | A | 12/1998 | Onishi et al. | |
| 5,979,098 | A | 11/1999 | Griggs | |
| 6,101,918 | A | 8/2000 | Akins | |
| 6,164,002 | A | 12/2000 | Troncoso | |
| 6,189,525 | B1 | 2/2001 | Kutrubes | |
| 6,318,014 | B1 | 11/2001 | Porter | |
| 6,553,707 | B1 | 4/2003 | Tseng | |
| 6,662,485 | B2 | 12/2003 | Kay | |
| 6,732,466 | B2 | 5/2004 | Bentley | |
| 6,807,763 | B1 | 10/2004 | Leung | |
| 6,966,138 | B1 | 11/2005 | Deckard | |
| 7,162,822 | B1 | 1/2007 | Heayn et al. | |
| 7,213,498 | B1 | 5/2007 | Davies | |
| 7,225,574 | B2 | 6/2007 | Crandall et al. | |
| 7,273,002 | B1 | 9/2007 | Rogers | |
| 7,340,857 | B1 | 3/2008 | Bentley | |
| 7,398,723 | B1 | 7/2008 | Blakley | |
| 7,478,495 | B1 | 1/2009 | Alzamora et al. | |
| 7,562,614 | B2 | 7/2009 | Polston | |
| 7,596,900 | B2 | 10/2009 | Robinson et al. | |
| 7,673,413 | B2 | 3/2010 | Bentley | |
| 7,716,864 | B2 | 5/2010 | Skrubis et al. | |
| 7,762,018 | B1 | 7/2010 | Fitzpatrick et al. | |
| 7,805,873 | B2 | 10/2010 | Bentley | |
| 7,823,313 | B2 * | 11/2010 | Faifer | F41C 23/06 42/1.06 |
| 7,966,760 | B2 | 6/2011 | Fitzpatrick et al. | |
| D645,110 | S | 9/2011 | Cook et al. | |
| 8,051,593 | B2 | 11/2011 | Vesligaj | |
| 8,127,658 | B1 | 3/2012 | Cottle | |
| 8,176,835 | B1 | 5/2012 | Cottle | |
| 8,356,542 | B2 * | 1/2013 | Cottle | F41A 19/11 42/69.01 |
| 8,371,208 | B2 | 2/2013 | Cottle | |
| 8,448,562 | B2 * | 5/2013 | Cottle | F41A 19/11 42/69.01 |
| 8,459,171 | B2 * | 6/2013 | Cottle | F41A 19/06 42/94 |
| 8,474,169 | B2 | 7/2013 | Cottle et al. | |
| 8,555,541 | B2 | 10/2013 | Ingram | |
| 8,806,791 | B2 * | 8/2014 | Cottle | F41A 19/11 42/71.01 |
| 8,950,099 | B2 | 2/2015 | Rogers et al. | |
| 8,955,245 | B2 | 2/2015 | Chvala | |
| 9,091,505 | B1 * | 7/2015 | Battaglia | F41C 23/20 |
| 9,121,663 | B2 | 9/2015 | Troy et al. | |
| 9,207,042 | B1 * | 12/2015 | Erskine | F41C 27/00 |
| 9,410,763 | B2 | 8/2016 | Colt | |
| 2003/0101631 | A1 | 6/2003 | Fitzpatrick et al. | |
| 2004/0055200 | A1 | 3/2004 | Fitzpatrick et al. | |
| 2005/0183312 | A1 | 8/2005 | Speaks | |
| 2005/0235546 | A1 | 10/2005 | Wonisch et al. | |
| 2006/0010749 | A1 | 1/2006 | Kincel | |
| 2006/0123683 | A1 | 6/2006 | Garrett et al. | |
| 2006/0248772 | A1 | 11/2006 | Curry | |
| 2007/0084101 | A1 | 4/2007 | Pikielny | |
| 2007/0101631 | A1 | 5/2007 | Bentley | |
| 2007/0138219 | A1 | 6/2007 | Kovalchuk et al. | |
| 2007/0261284 | A1 | 11/2007 | Keng | |
| 2007/0266845 | A1 | 11/2007 | Polston | |
| 2008/0110074 | A1 | 5/2008 | Bucholtz et al. | |
| 2009/0126249 | A1 | 5/2009 | Crommett | |
| 2009/0139128 | A1 | 6/2009 | Fluhr | |
| 2009/0255161 | A1 | 10/2009 | Fitzpatrick et al. | |
| 2009/0313872 | A1 | 12/2009 | Goertz | |
| 2010/0071246 | A1 | 3/2010 | Vesligaj | |
| 2010/0205846 | A1 | 8/2010 | Fitzpatrick et al. | |
| 2010/0229444 | A1 | 9/2010 | Faifer | |
| 2010/0242328 | A1 | 9/2010 | Faifer | |
| 2010/0242333 | A1 | 9/2010 | Kincel | |
| 2011/0067226 | A1 | 3/2011 | Westbrook | |
| 2011/0113665 | A1 * | 5/2011 | Cottle | F41C 23/04 42/73 |
| 2011/0167704 | A1 | 7/2011 | Chupp | |
| 2011/0173863 | A1 | 7/2011 | Ingram | |
| 2011/0185618 | A1 | 8/2011 | Jamison et al. | |
| 2011/0225865 | A1 | 9/2011 | Williams | |
| 2011/0283587 | A1 | 11/2011 | Sharp et al. | |
| 2012/0000108 | A1 | 1/2012 | Zusman | |
| 2012/0000109 | A1 | 1/2012 | Zusman | |
| 2012/0042556 | A1 | 2/2012 | Vesligaj | |
| 2012/0186122 | A1 | 7/2012 | Zamlinsky et al. | |
| 2012/0240442 | A1 * | 9/2012 | Cottle | F41A 19/11 42/71.01 |
| 2012/0260793 | A1 | 10/2012 | Gomez | |
| 2012/0311907 | A1 | 12/2012 | Cottle | |
| 2013/0047379 | A1 * | 2/2013 | Zilke | F41B 5/148 16/421 |
| 2013/0074685 | A1 * | 3/2013 | Cottle | F41A 19/06 89/27.11 |
| 2013/0097911 | A1 | 4/2013 | Larue | |
| 2013/0288204 | A1 | 10/2013 | Taylor | |
| 2014/0007763 | A1 * | 1/2014 | Foster | F41A 19/03 89/136 |
| 2014/0082983 | A1 * | 3/2014 | Ermossa | F41C 23/10 42/69.01 |
| 2014/0259848 | A1 | 9/2014 | Chvala | |
| 2016/0187099 | A1 * | 6/2016 | Cottle | F41C 23/14 42/73 |

OTHER PUBLICATIONS

"Akins Accelerator Decision v 2.0"; Purported internet discussion thread. Jan. 9-Jun. 30, 2007. [http://thefiringline.com/forums/archive/index.php?t-234087.html].

"Another neutered Akins accelerator FS"; Purported internet discussion thread. Jan. 19-30, 2009. [http://1919a4.com/showthread.php?21872-Another-neutered-Akins-accelerator-FS].

"ATF reverses decision . . . "; Purported internet discussion thread. Dec. 6-24, 2006. [http://www.thehighroad.org/archive/index.php/t-240357.html].

"Bill_Akins > albums > Private concepts"; Purported video posted to internet. Oct. 16, 2008. [http://good-times.webshots.com/video/301122838009976397 0axOjzH].

"Just Wanted to Show Off My Bumpfiring Toy"; Purported internet discussion thread with embedded videos. Nov. 13, 2008-May 14,

(56) References Cited

OTHER PUBLICATIONS

2010; Relevant pages may include p. 1 of 2. [http://forum.saiga-12.com/index.php?/topic/31610-just-wanted-to-show-off-my-bumpfiring-toy-p/].
"More Thoughts on the Akins Accelerator"; Purported internet discussion thread. May 29, 2008-Sep. 25, 2009. [http://armsandthelaw.com/archives/2008/05/atkins_accelera.php].
"Screw the ATF and 1022"; Purported internet discussion thread. Apr. 10-11, 2007. [http://www.thehighroad.org/archive/index.php/t-268573.html].
"Turn in Your Killer Springs Here"; Purported internet discussion thread. Jan. 9-10, 2007. [http://www.thehighroad.org/archive/index.php/t-246764.html].
"Bump Firing"; Purported internet discussion thread. Jan. 21, 2004 by online user "Packrat".
"Can You Bump Fire a Ruger 10/22?"; Purported internet discussion thread. Mar. 7, 2007 by online user "rugerdude".
"Hellfire System"; Purported internet discussion thread. Mar. 31, 1997 by online user "GOJPO".
Michael Foeller II letter from US US Department of Justice, Bureau of Alcohol, Tobacco, Firearms and Explosives, Jun. 18, 2008.
Michael Johnson letter from US Department of Justice, Bureau of Alcohol, Tobacco, Firearms and Explosives, Jun. 26, 2008.
Public Online forum, http://uzitalk.com/forums/archive/index.php/t-24944.html, "Akins Accelerator Critical Update," posted Feb. 9, 2007 to Jan. 22, 2008 by online user Vegas SMG as viewed on Apr. 19, 2016.

* cited by examiner

FIG. 9
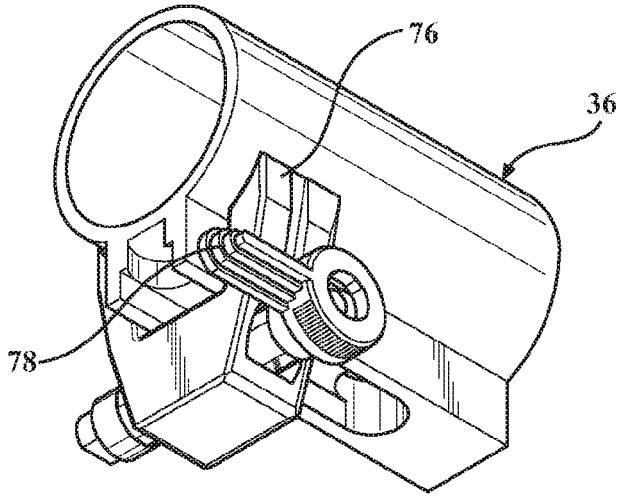
FIG. 10
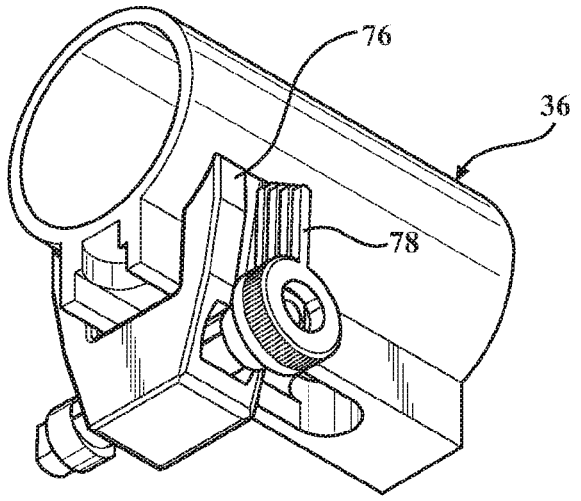
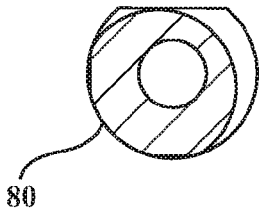
FIG. 11
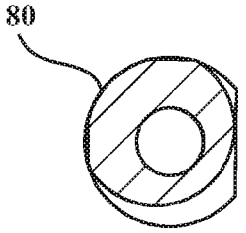
FIG. 12

ADJUSTABLE LENGTH SLIDE-ACTION RIFLE STOCK

CROSS REFERENCE TO RELATED APPLICATIONS

This application claims priority to Provisional Patent Application No. 62/098,850 filed Dec. 31, 2014, the entire disclosure of which is hereby incorporated by reference and relied upon.

BACKGROUND OF THE INVENTION

Field of the Invention

The present invention relates generally to firearms, and more particularly toward a manually reciprocated gun stock or handle for enabling controlled rapid fire of a semi-automatic firearm.

Description of Related Art

Various techniques and devices have been developed to increase the firing rate of semi-automatic firearms. Slide Fire Solutions LP, of Moran, Tex., Applicant of this present invention, markets a proprietary slide-action stock under the registered trademark SLIDE FIRE. The SLIDE FIRE® slide-action stock is described for example in detail in US 2012/0240442, published Sep. 27, 2012 and US 2012/0311907 published Dec. 13, 2012, the entire disclosures of which are hereby incorporated by reference and relied upon.

The slide-action stocks in these exemplary citations include a shoulder stock portion having a rearwardly facing butt end that is adapted to be pressed into the shoulder of a user, a pistol grip portion adapted to be grasped by the user's hand, and a finger rest configured to stabilize the end of a user's trigger finger stretched in front of the trigger of the firearm while the remaining fingers of the user's hand clench the pistol grip. The shoulder stock and pistol grip and finger rest are fixed together as a monolithic handle unit that, in use, is held tight to the user's body. When used in a rapid-fire slide-action mode of operation, the handle unit supports a firing unit portion of the firearm—namely the barrel, receiver and trigger—for manual reciprocation back-and-forth over a short (e.g., about one inch) travel distance. In the hands of a practiced and responsible user, the handle unit allows the reciprocation of the firing unit to be timed in counterpoise with the recoil from each fired round of ammunition, which in turn allows a very short time interval between each successive round fired.

In the prior art examples, the distance between the butt end of the shoulder stock and the finger rest is non-adjustable. That is, the trigger pull length, which is generally defined as the distance between butt end of the shoulder stock and the trigger in a rifle, is non-adjustable. As a result, users with exceptionally long or short arms, or that wear especially thick clothing, could find the firearm fit to be less than ideal. Shooting accuracy may suffer as a result of poor fit.

Adjustable and/or collapsible shoulder stocks are made for non-slide-action semi-automatic long rifles, including as two examples those produced by Magpul, Inc. and Tapco, Inc. Such prior art adjustable shoulder stocks usually include a lever-actuated latch that is manipulated by the user to selectively place a small plunger in any one of several adjustment holes aligned in a row along the bottom of a buffer tube (or of a comparable shaft-like feature) that extends rearwardly from the firearm receiver. To adjust the shoulder stock length, i.e., the trigger pull length, a user manually withdraws the plunger (via the lever actuator of the latch) then slides the shoulder stock to a preferred adjusted length position. Upon release of the lever actuator, the plunger seats itself in the nearest adjustment hole thus securing the shoulder stock in the length-adjusted position.

Such prior art adjustable shoulder stocks are generally incompatible with slide-action reciprocating handles. For one reason, slide-action handles may use the same row of adjustment holes along the buffer tube (or comparable shaft-like feature) as a lock-out feature to selectively impede the slide-action mode of operation. Another reason that prior art adjustable shoulder stocks have been deemed incompatible with a slide-action reciprocating handles is that there has been no effective way to couple the prior art adjustable stock to the pistol grip and to a finger rest as a monolithic handle unit while incorporating a reciprocating interface with the firing unit portion of the firearm. While those not well-acquainted with the art may naively suppose design of an adjustable slide-action handle to be a relatively straightforward engineering exercise, such is in fact not at all readily apparent to the skilled artisan due, at least in part, to the requirements that shoulder stock and pistol grip be integrated into a monolithic handle unit that, in use, remains held tight to the user's body while the firing unit portion of the firearm rapidly reciprocates back-and-forth. A still further reason that prior art adjustable shoulder stocks have been deemed incompatible with slide-action reciprocating handles is that a prior art adjustable shoulder stock is intended to be locked relative to the firing unit in an adjusted position for use. A shoulder stock locked in position relative to the firing unit would impede slide-action shooting.

Another shortcoming that exists in prior art slide-action stocks has been the fact that different stock designs are required to accommodate left-handed and right-handed shooters. A right-handed shooter wants the finger rest to be located on the left side of the trigger. Conversely, a left-handed shooter wants the finger rest to be located on the right side of the trigger.

A still further shortcoming that exists in prior art slide-action stocks has been raised by competitive shooters that require a solid, stable connection between handle and firing unit. That is to say, for some users that shoot at a slow pace in normal semi-automatic mode, any degree of play between firing unit and handle could pose a concern. However, a slide-action handle required there to be at least a running fit clearance to allow the firing unit to rapidly reciprocate within the handle. Too tight of a fit will not only impede the raid-fire, slide-action mode of operation, but also possibly result in accelerated wear of the sliding components.

And yet another shortcoming that exists in prior art slide-action stocks has been identified by some in the location of the slide-action lock-out feature. As mentioned above, there may be times when a user wants to operate the firearm in a traditional, semi-automatic mode firing rounds of ammunition at a relatively slow cadence. In these situations, the user may wish to arrest all longitudinal reciprocating action between the handle and the firing unit. The prior art has taught to incorporate a lock-out feature for this purpose at a mid-point location between butt end and pistol grip. The location of the prior art lock-out features and generated concerns by some users, as being not optimally ergonomic.

Therefore, there exists a continuing need for further improvements in devices that will allow a firearms user to practice slide-action shooting in the most effective manner possible, and in which users of varying arm lengths may experience the sport with proper fit, and in which left-handed and right-handed shooters can enjoy by sharing use of the same firearm, and in which competitive shooters can practice carefully aimed shots from a solid, stable handle, and where the lock-out feature is more ergonomic and versatile.

BRIEF SUMMARY OF THE INVENTION

According to a first aspect of this invention, a manually-actuated slide-action stock assembly is provided for a semi-automatic firearm of the type having a finger-actuated trigger. The assembly comprises a slide-action handle configured for slideable attachment to the firing unit portion of a semi-automatic firearm so that the firing unit longitudinally reciprocates within the handle when in a rapid-fire mode of operation. The handle includes a finger rest configured to stabilize the end of a user's trigger finger stretched in front of the trigger. The finger rest is detachable from the chassis and has a generally U-shaped configuration adapted to connect to the handle in either a right-handed position or an inverted left-handed position.

According to a second aspect of this invention, a slide-action stock assembly is provided for a semi-automatic firearm of the type having a longitudinally reciprocating firing unit. The assembly comprises a first bearing interface adapted for connection directly behind the trigger of a semi-automatic firing unit. The assembly also includes a slide-action handle. The handle has a first bearing slide-way that is disposed in sliding connection with the first bearing interface to enable longitudinally reciprocating movement when in a rapid-fire slide-action mode of operation. The handle also has a finger rest is configured to stabilize the end of a user's trigger finger stretched in front of the trigger of the firearm. Furthermore, the handle includes a lock switch that is engageable with the firing unit to selectively arrest relative sliding movement between the firing unit and the handle. The lock switch includes a tab that is moveable into and out of engagement with the first bearing interface.

According to a third aspect of this invention, a slide-action stock assembly is provided for a semi-automatic firearm having a longitudinally reciprocating firing unit. The assembly comprises a first bearing interface adapted for connection directly behind the trigger of a semi-automatic firing unit, and a second bearing interface adapted for connection to a firing unit. The second bearing interface is spaced apart from the first bearing interface. The assembly includes a slide-action handle. The handle has a first bearing slide-way and a second bearing slide-way. The first bearing slide-way is disposed in sliding connection with the first bearing interface for longitudinally reciprocating movement when in a rapid-fire slide-action mode of operation. The second bearing slide-way is disposed in sliding connection with the second bearing interface. The handle includes a finger rest configured to stabilize the end of a user's trigger finger stretched in front of the trigger of the firearm. And a brake is disposed for movement between extended and retracted positions within the second bearing slide-way. The brake has a generally v-shaped friction block. An engagement lever is operatively connected to the friction block for selectively moving the friction block between a disengaged condition and an engaged condition.

According to a fourth aspect of this invention, a manually-actuated slide-action stock assembly is provided for a semi-automatic firearm of the type having a finger-actuated trigger. The assembly comprises a slide-action handle configured for slideable attachment to the firing unit portion of a semi-automatic firearm so that the firing unit longitudinally reciprocates within the handle when in a rapid-fire mode of operation. The handle includes a finger rest configured to stabilize the end of a user's trigger finger stretched in front of the trigger. The handle is comprised of a chassis portion and a shoulder stock portion. An adjuster track extends longitudinally along the chassis portion. The shoulder stock includes an adjuster pin that is disposed for movement into and out of registry with the adjuster track to enable a user to alter the trigger pull length of the firearm.

The present invention enables a firearms user to practice slide-action shooting in the most effective manner possible. In some aspects, the invention allows users of varying arm lengths to experience the sport with proper fit. In some aspects, the invention allows left-handed and right-handed shooters to share use of the same firearm. In some aspects, the invention enables competitive shooters to practice carefully aimed shots while holding a solid, stable handle. And in some aspects, the invention provides a more ergonomic and versatile lock-out feature.

BRIEF DESCRIPTION OF THE SEVERAL VIEWS OF THE DRAWINGS

These and other features and advantages of the present invention will become more readily appreciated when considered in connection with the following detailed description and appended drawings, wherein:

FIG. 9 is a fragmentary perspective view of a second bearing element/buffer tube and the V-shaped friction block in the disengaged condition;

FIG. 10 is a view as in FIG. 9 but showing the V-shaped friction block in the engaged condition;

FIG. 11 is a cross-sectional view of the eccentric cam corresponding to the disengaged condition of the V-shaped friction block and FIG. 9;

FIG. 12 is a cross-sectional view of the eccentric cam corresponding to the engaged condition of the V-shaped friction block and FIG. 10;

DETAILED DESCRIPTION OF THE INVENTION

This invention is related by subject matter to the Applicant's own international patent Publication No. WO/2014078462, published on May 22, 2014, and also to its U.S. Pat. No. 8,176,835, issued May 15, 2012, the entire disclosures of which are hereby incorporated by reference and relied upon.

Figure 1:
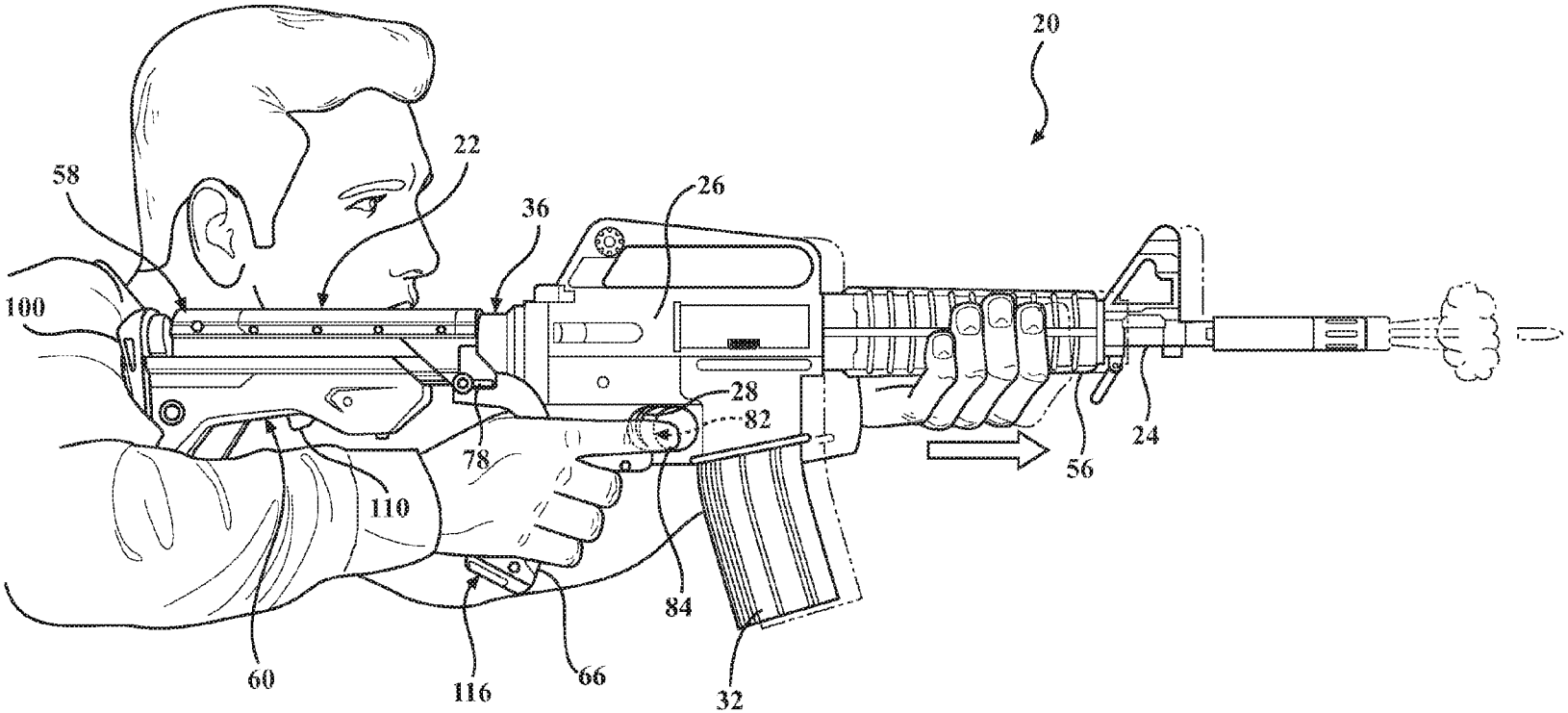
FIG. 1 is a side elevation view of a user holding a firearm equipped with a slide-action handle assembly according to one embodiment of this invention.

Referring to the Figures, wherein like reference numerals indicate like or corresponding parts throughout the several views, a user is shown in FIG. 1 operating a semi-automatic firearm, generally shown at 20, that is configured for rapid-fire, slide-action shooting. It will be understood that the principles of this invention are adaptable to many different makes and models of firearms 20. The exemplary embodiment of the invention depicted in FIGS. 1-18 is configured specifically for use with AR platform firearms 20, such as the popular AR-15 and AR-10. However, the invention may be practiced with other makes and models of firearms given corresponding modifications that will be apparent to a gunsmith or firearms engineer of ordinary skill To be sure, many aspects of the disclosed invention may be implemented in handguns as well as all type of long-guns and rifles, and the ensuing description that relies heavily on the AR-platform is not intended to preclude any possible alternative applications even though not specifically mentioned herein.

Figure 2:
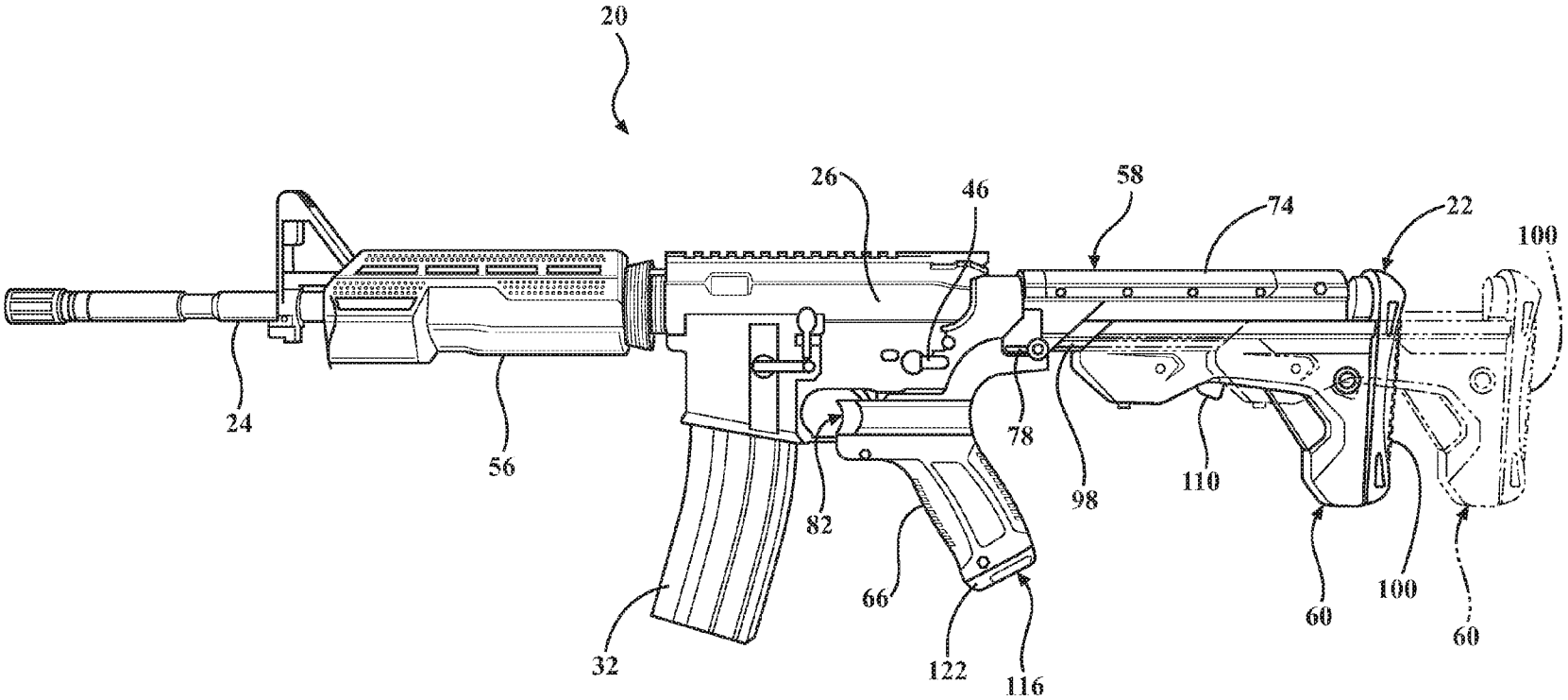
FIG. 2 is a side-elevation of a different firearm equipped with slide-action handle assembly illustrating the adjustable trigger-pull length capability in phantom lines.

The firearm 20 of this invention is composed of two main components: a firing unit and a slide-action handle, generally indicated at 22. The firing unit comprises those components which, in the slide-action mode of operation, are manually reciprocated back-and-forth in the handle 22. The elements of the firing unit include at least a barrel 24, a receiver 26 and a trigger 28. The barrel 24 is a tubular construction, usually quite long, designed to guide the discharge of a bullet along a generally linear trajectory. The barrel 24 includes a chamber at one end thereof, and a muzzle at the other end. The receiver 26 is a working mechanism designed to mechanically feed successive live rounds of ammunition into the chamber, and to expel spent shells from the chamber as bullets are discharged. In AR-platforms, receiver 26 may be further defined as having separable upper and lower parts. The receiver 26 may also be fitted with a grip mounting lug. The grip mounting lug is not shown in the accompanying drawing figures of this patent application, however it is a common feature well-known to those of skill in the art. For reference, a grip mounting lug of this type is shown and described in the aforementioned WO/2014078462 in its FIG. 4 (reference number 44). The typical grip mounting lug in AR-platforms is located directly behind the trigger 28, and is configured with a threaded bore so as to receive a standard threaded fastener 30 (shown in phantom in FIG. 15). A cartridge magazine 32 is shown in FIGS. 1 and 2 operatively fitted in a mag well portion of the receiver 26 for storing a supply of live ammunition to be fed, on demand, into the chamber.

The firing unit includes at least one bearing feature with which to couple the handle 22 for longitudinally reciprocating movement therebetween when in a rapid-fire slide-action mode of operation. The bearing feature can take many different forms. One or more sliding bearings are contemplated, as well as linked mechanisms and pivoted couplings and other mechanical constructs to accomplish the longitudinally reciprocating movement necessary for rapid-fire, slide-action mode. In the embodiment illustrated in the Figures, the bearing feature includes a first bearing interface 34 and a distinct, spaced-apart, second bearing interface 36. These first 34 and second 36 bearing interfaces establish a guided travel path against which the firing unit rides in the handle 22 along back-and-forth directions generally parallel to the long axis of the barrel 24. In practice, about one inch (1") of back-and-forth travel is needed to adequately operate the firearm 20 in rapid-fire, slide-action mode. A detailed description of the rapid-fire, slide-action mode of operation may be found in the afore-mentioned U.S. Pat. No. 8,176,835.

The first bearing interface 34 is shown in FIGS. 4 and 13-18. It will be understood that the first bearing interface 34 can take many different forms, and is even optional to the extent the invention is capable of operation with only a single bearing feature as mentioned above. When the firearm 20 is built on the AR platform, as shown in the illustrations, the first bearing interface 34 is directly connected to the previously described grip mounting lug. In other firearm platforms, the first bearing interface 34 could be connected to (or otherwise utilize) a different part of the firing unit. For example, in AK-47 platforms, there is a suitable space to attach a first bearing interface under its receiver and directly behind its trigger. For firearms 20 in the form of a semi-automatic handgun, an adaptation of the first bearing interface 34 provides a particularly useful, and perhaps the only practical, bearing feature within which to slidably couple the firing unit to the handle 22.

Figure 13:
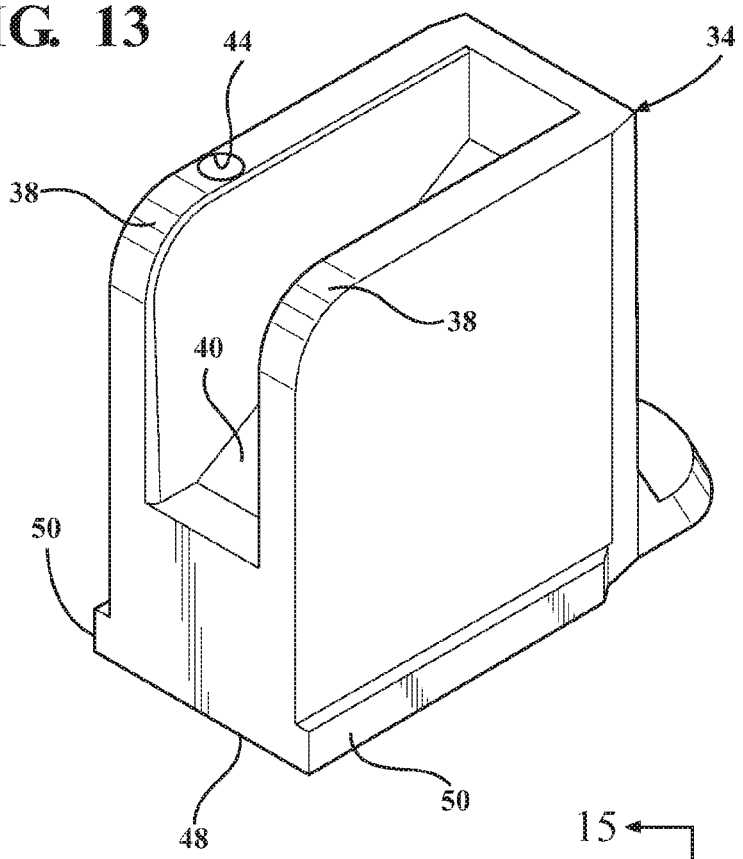
FIG. 13 is a perspective view of the first bearing interface according to one exemplary embodiment of the present invention.
Figure 14:
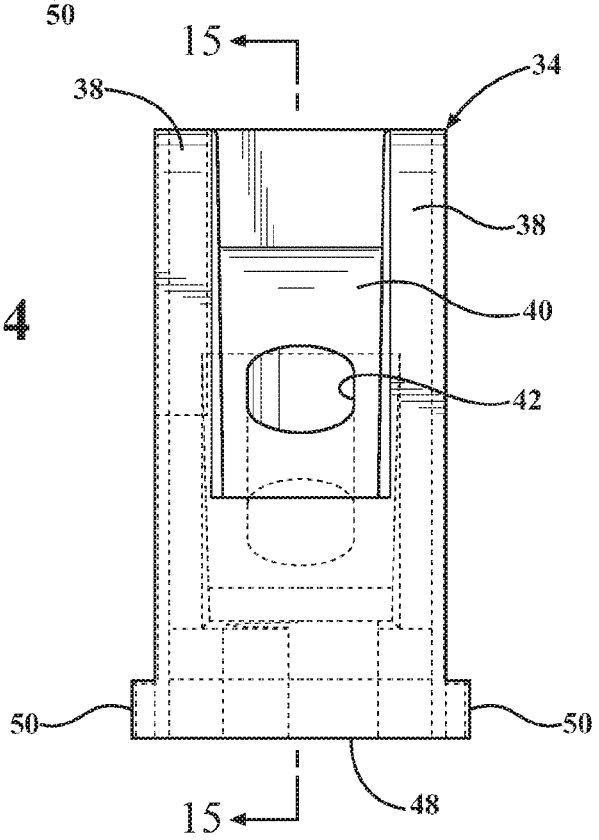
FIG. 14 is a front elevation view of the first bearing interface of FIG. 13.
Figure 15:
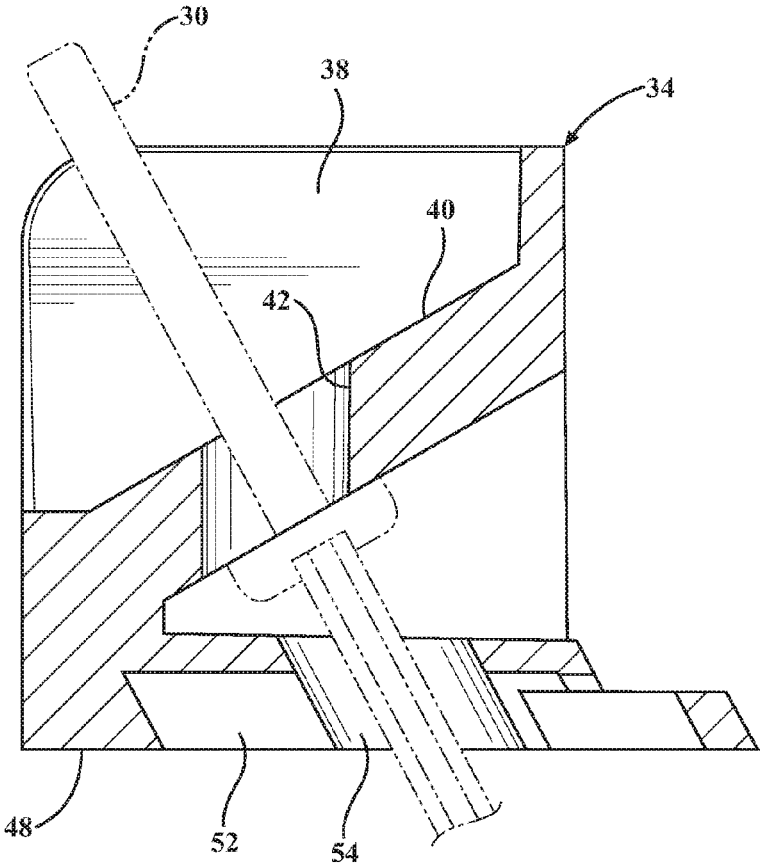
FIG. 15 is a cross-sectional view taken generally along lines 15-15 of FIG. 14.
Figure 16:
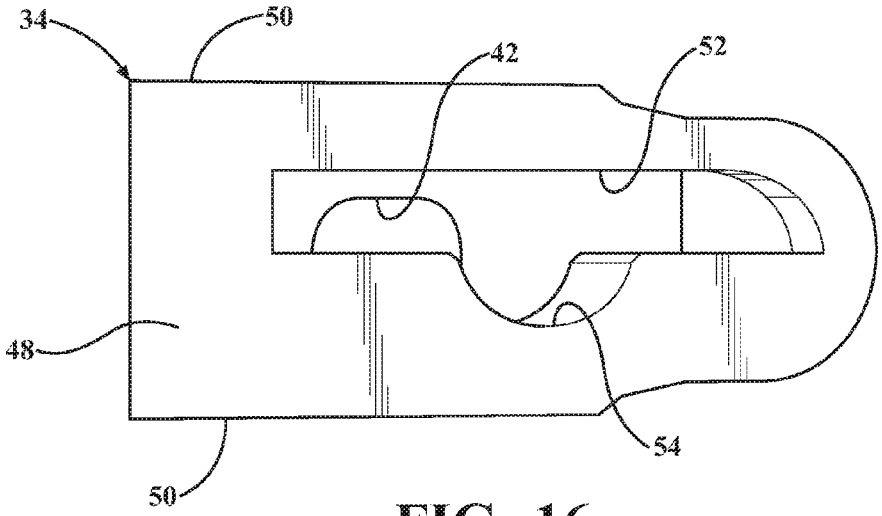
FIG. 16 is a bottom view of the first bearing interface of FIG. 13.

Returning again to the case of AR platforms, the first bearing interface 34 may be formed with a pair of upstanding ears 38 spaced apart from one another across a sloped mounting surface 40 as shown in FIGS. 13-15. The ears 38 and sloped mounting surface 40 are matched to the external shape of the grip mounting lug so that the first bearing interface 34 attaches with a tight mated fit. A hole 42 in the sloped mounting surface receives the threaded fastener 30 so as to securely hold the first bearing interface 34 in position on the grip mounting lug. (The reader is invited to consult WO/2014078462 for illustration of this connection). At least one of the ears 38 includes a safety spring hole 44 to retain the OE safety spring in proper position for maintaining functionality of the safety selector switch 46 (FIG. 2). The first bearing interface 34 has a bottom portion 48. A pair of flanges 50 extend laterally outwardly from the bottom portion 48 of the first bearing interface 34, as perhaps best shown in FIGS. 13 and 14. A lock-out slot 52 is disposed in the bottom portion 48 of the first bearing interface 34. The lock-out slot 52 may include a semi-circular lock-notch 54, as shown in FIG. 16. Of course, in other variants the lock-notch 54 could take a shape other than semi-circular, and could even exist as a feature disassociated with the lock-out slot 52. That is to say, the lock-notch 54 could be configured as a distinct feature of the first bearing interface 34, such as a recessed exterior formation. Furthermore, in other contemplated embodiments the lock-notch 54 could be designed as a protruding feature on the first bearing interface 34, such as a bump or a tab, so as to accomplish the novel lock-out purposes of this invention, which will be described more fully below.

The second bearing interface 36 can also take many different forms, and is optional to the extent the invention is capable of operation with any suitable single bearing feature as in the handgun example mentioned above, not to mention other contemplated rifle variations in which only a single bearing feature might be needed. For AK-47 type platforms, the second bearing interface 36 could, for example, take the form of a post-like extension similar to that depicted in WO/2014078462. In AR platform firearms 20, on the other hand, the receiver 26 already conveniently includes a rearwardly extending buffer tube that houses a large coil spring. This buffer tube can be multi-purposed for use as the second bearing interface 36 in AR-type rifles. As the figures illustrate an AR platform, the OE buffer tube is therefore identified as the second bearing interface 36 in FIGS. 1, 9 and 10. (The buffer tube/second bearing interface 36 is mostly obstructed from view in FIG. 2 by the handle 22.) The standard OE buffer tube, both the commercial and Mil-Spec types, has a lug rail that extends axially along a lowermost portion thereof. A fragment of an OE buffer tube and its lug rail are depicted in FIGS. 9 and 10. The reader is invited to consult the afore-mentioned U.S. Pat. No. 8,176,835 for enhanced descriptions and depictions of an OE buffer tube for AR-platform firearms 20, which include a lug rail that houses a plurality of axially spaced holes used to set the shoulder-stock length for traditional adjustable length shoulder stocks. The outer, longitudinally extending surface of the buffer tube comprises a second bearing interface 36 in this embodiment. In other words, for AR-type firearms 20, the second bearing interface 36 is composed of the mostly-cylindrical outside surface of an OE buffer tube, in combination with the planar outside edges of its lug rail. These combined surfaces provide a reasonably smooth sliding interface against which complimentary portions of the handle 22 can rub when the firearm 20 is used in the rapid-fire, slide-action mode of operation.

The trigger 28 is part of a trigger group, or trigger mechanism, that is housed within the receiver 26. In well-known fashion, the trigger 28 is thus operatively associated with the receiver 26 for activating a live round of ammunition disposed in the chamber portion of the barrel 24. Those of skill in the art will ready understand the assembly and operating principles of a semi-automatic trigger group, as that system is adapted for various types and platforms of firearms 20.

Figure 3:
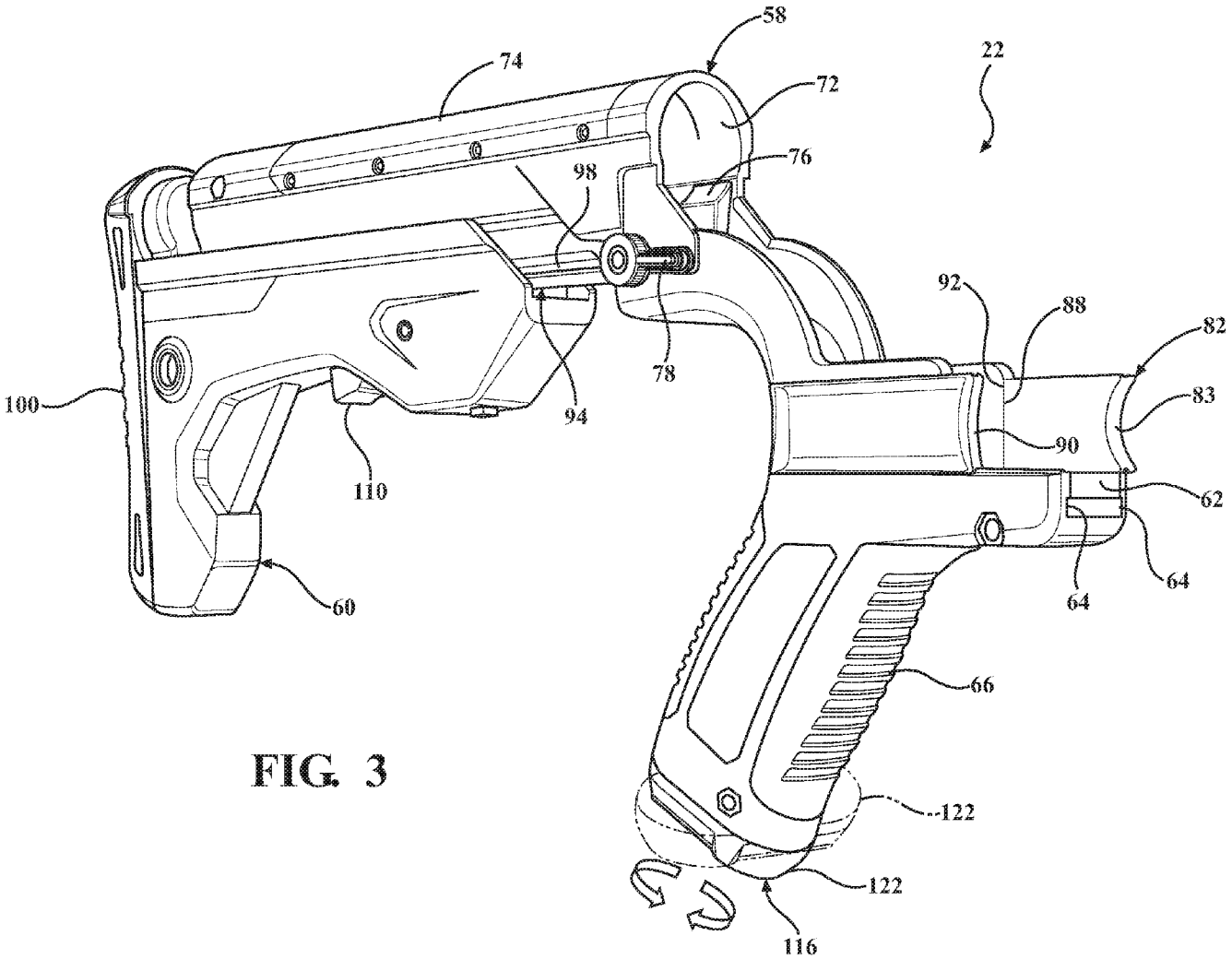
FIG. 3 is a perspective view of a slide-action handle assembly according to one embodiment of this invention.
Figure 4:
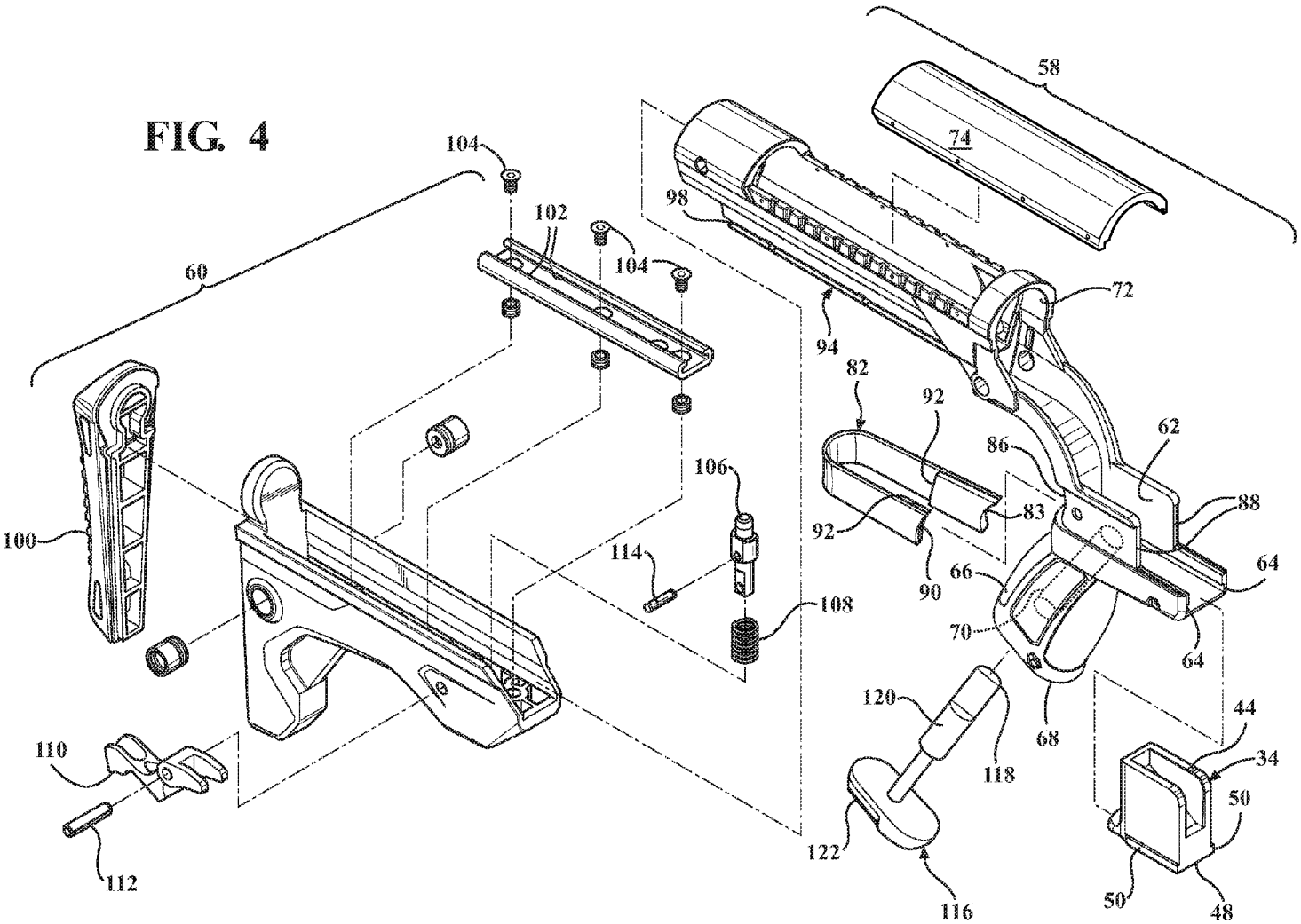
FIG. 4 is an exploded view of the slide-action handle assembly of FIG. 3.
Figure 5:
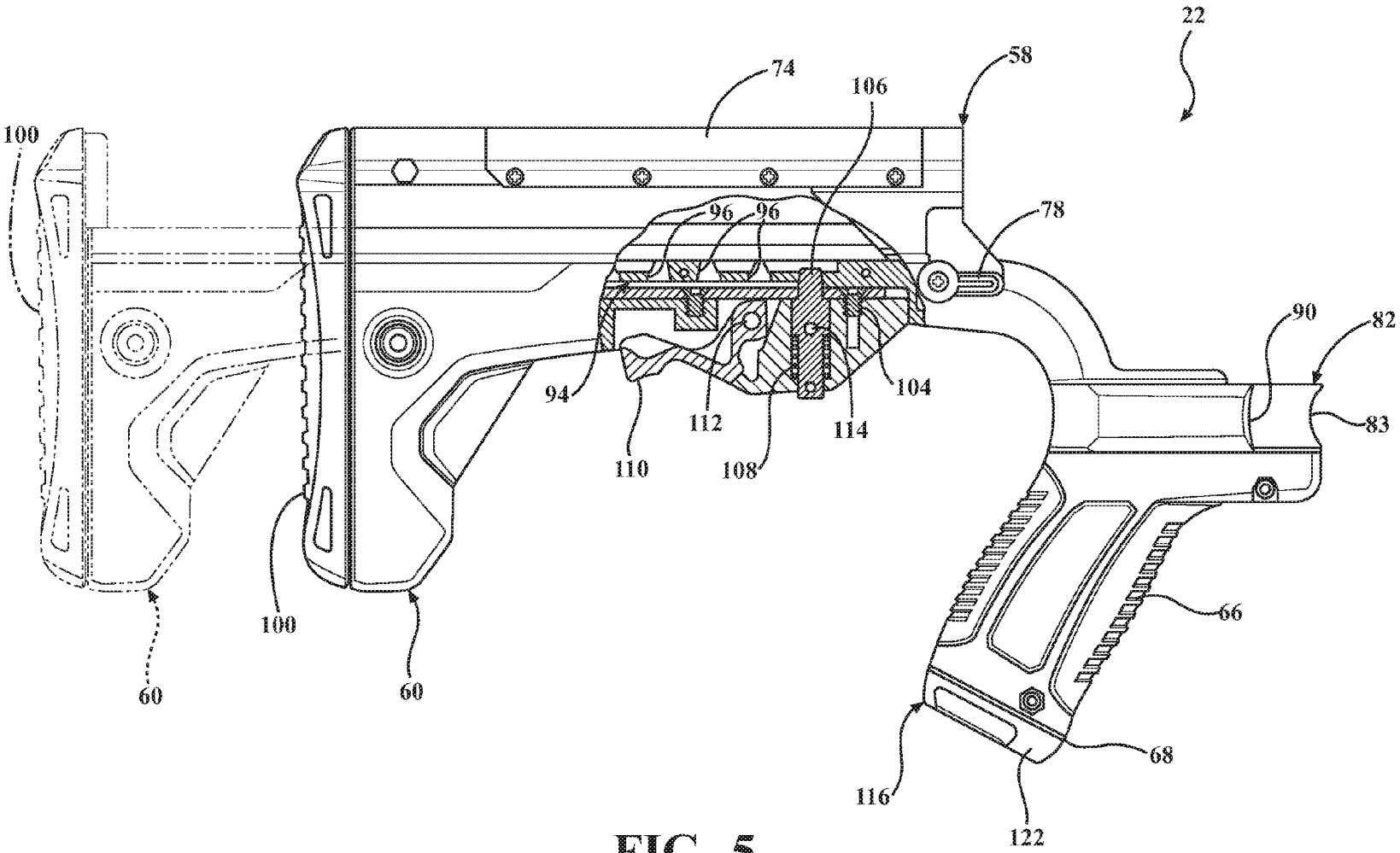
FIG. 5 is a side view of the slide-action handle assembly of FIG. 3, showing in partial cross-section to reveal the adjuster track and pin coupling, and further illustrating the adjustable trigger-pull length capability in phantom lines.

Turning now to the handle 22, reference is made initially to FIGS. 3-5. To reiterate, the handle 22 comprises those elements of the firearm 20 which, in use, are intended to be held tight to the user's body, as illustrated in FIG. 1, and which provide a sturdy feature for the user to hold and aim the firearm 20. For a person that shoots right-handed, the handle 22 will be pulled in tight by the user's right hand against their right shoulder. A right-handed shooter is depicted in FIG. 1. Conversely, for a left-handed shooter, the handle 22 will be anchored to the user's left shoulder via their left hand in locked tension. When the firearm 20 is operated in the rapid-fire, slide-action mode, the handle 22 remains generally anchored to the user's rear shoulder. So in the example of FIG. 1, during rapid-fire, slide-action mode all parts of the handle 22 will remain relatively stationary as they are pulled tight against the shooter's right shoulder by his right arm and hand. However, the shooter's left arm and hand (holding a front handguard 56) will be continuously pumping back and forth with the reciprocating firing unit. It will be seen, therefore, that during the rapid-fire, slide-action mode of operation, the handle 22 remains stationary (relative to the user's rear shoulder) while the firing unit (i.e., barrel 24, receiver 26 and trigger 28) rapidly reciprocate in the fore-and-aft direction.

The handle 22 includes two primary components: a chassis, generally indicated at 58, and a shoulder stock, generally indicated at 60. In use, these two components 58, 60 of the handle 22 are fixed together so that they form an integral unit, meaning that the chassis 58 and shoulder stock 60 portions are locked in unitary relationship with one another. However, when the firearm 20 is not in use, i.e., not firing ammunition, the relative positions of the chassis 58 and shoulder stock 60 can be shifted, or adjusted, so as to change the trigger pull distance to accommodate the preferences of the user. A particularly tall or long-armed user may wish to adjust the relative positions of the shoulder stock 60 and chassis 58 to an extreme in one direction, whereas a particularly small or short-armed user may wish to adjust in the opposite direction for improved comfort.

The chassis 58 includes those portions of the handle 22 that directly attach to the firing unit. Such direct attachment is accomplished principally through the one or more bearing features of the firing unit. In the illustrated examples for the AR-platform, the chassis 58 includes a first bearing slide-way 62 for slideable connection with the first bearing interface 34 as perhaps best shown in FIGS. 3 and 4. The first bearing slide-way 62 comprises generally parallel sidewalls adapted to receive therebetween the ears of the first bearing interface 34 for sliding engagement in the fore-and-aft direction. The first bearing slide-way 62 also has a pair of side slots 64 configured to receive the flanges 50 of the first bearing interface 34. That is, the shape of the first bearing slide-way 62 somewhat resembles a T-slot adapted to receive the complimentary-shaped profile of the first bearing interface 34 with a near-precision running fit. If in another embodiment the first bearing interface 34 is shaped differently than that shown in the figures, then the first bearing slide-way 62 may also be adapted to the different shape so that the two members 34, 62 can be mated with a smooth sliding fit.

A pistol grip 66 is ergonomically designed for a comfortable grip by the user's trigger hand. A right-handed shooter (as illustrated in FIG. 1) will grasp the pistol grip 66 with their right hand, and conversely a left-handed shooter (not shown) will grasp the pistol grip 66 with their left hand. The hand clutching the pistol grip 66 will pull the handle 22 inwardly against that same shoulder to securely anchor the firearm 20 for use. The pistol grip 66 is preferably a distinct protruding feature that extends downwardly from the first bearing slide-way 62 at an oblique back-angle. In other contemplated embodiments, the pistol grip 66 may comprise a necked-down region that flows directly into a shoulder stock section like those one-piece stocks commonly found in hunting rifles and shotguns. Various shapes and treatments to the tactile exterior of the pistol grip 66 are possible, and considered largely a matter of design choice. The pistol grip 66 has a grip base 68. Preferably, the grip base 68 has a symmetrical periphery, such that its front half is shaped identical to its rear half. A lock passage 70 (FIG. 4) extends through the pistol grip 66 and into the first bearing slide-way 62, thus forming a shaft journal for purposes to be described below. That is to say, the lock passage 70 passes through the inside of the pistol grip 66, with an opening at its lower end adjacent the grip base 68 and an opening at its upper end directly into the first bearing slide-way 62.

The chassis 58 includes a second bearing slide-way 72 for slideable connection with the second bearing interface 36. The second bearing slide-way 72 comprises an elongated tubular channel that extends rearwardly of the first bearing slideway 62. There is a lateral (vertical) as well as a longitudinal (axial) offset between the first 62 and second 72 bearing slide-ways that adds stability to the system when the firearm 20 is operated in the rapid-fire, slide-action mode. That is, the spaced-apart interfaces 34/36 and slide-ways 62/72 allow the firing unit to rapidly reciprocate within the handle 22 in a smooth and controlled manner. In order to improve the running fit afforded by the second bearing slide-way 72, a multi-part construction may be adopted like that shown in FIG. 4. The long channel of the second bearing slide-way 72 can thus be held to a more consistent tolerance relative to the second bearing interface 36 by separately forming a hood-like cover 74 that is subsequently affixed to the chassis 58 such as by screws, adhesive, welding, snap-fit, or any other suitable means. Furthermore, the body of the chassis 58 may be separately formed in left and right halves which are subsequently joined together.

The afore-mentioned running fit clearance between the interfaces 34/36 and slide-ways 62/72 is necessary to allow the firing unit to rapidly reciprocate within the handle 22. Of course, too tight of a fit will impede the raid-fire, slide-action mode of operation and/or result in accelerated wear of the sliding components. A reasonable running fit clearance nevertheless results in a slight sensation of wiggle, or play, between the handle 22 and the firing unit. For many users, the slight wiggle sensation is not objectionable. However, for competitive shooters shooting at a slow pace in normal semi-automatic mode, any degree of play between firing unit and handle 22 could pose a concern. For this reason, the chassis 58 is fitted with a brake disposed in the tubular channel for movement between extended and retracted positions. The brake can take many different forms and/or be implemented in several different ways. In the examples shown in FIGS. 3 and 8-12, the brake comprises a generally V-shaped friction block 76 disposed just inside the mouth of the second bearing slide-way 72 to straddle a lowermost section of the buffer tube and its lug rail. I.e., the friction block 76 is poised underneath the second bearing interface 36, near where it connects to the receiver 26. An engagement lever 78 is operatively connected to the friction block 76. The engagement lever 78, which is preferably two-ended (see FIG. 8) so as to be accessible from either the left or right-hand side of the chassis 58, is moveable from a disengaged condition to an engaged condition. In the illustrated examples, the movement is by way of a quarter-turn or 90-degree rotation of the engagement lever 78. In other contemplated embodiments, the engagement lever 78 can be configured to accept a different range of motion in order to actuate the friction block 76, e.g., a linear motion or a curvilinear motion.

Figure 8:
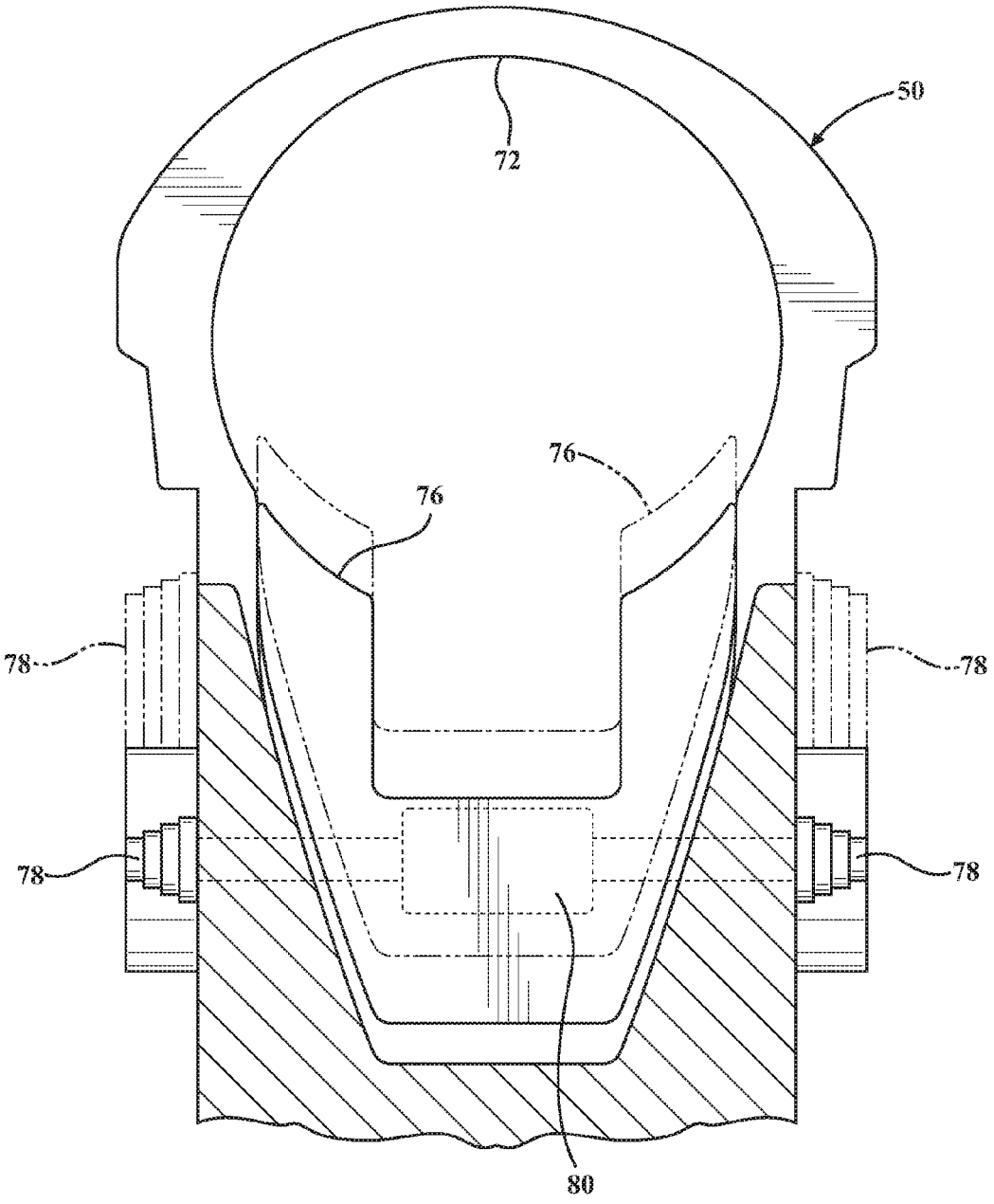
FIG. 8 is a cross-sectional view looking down the second bearing slide-way to show the V-shaped friction block in a lower disengaged condition in solid lines and in a raised engaged condition in phantom lines.

When the engagement lever 78 is in the disengaged condition, corresponding to FIGS. 9 and 11, the friction block 76 is in a lowered position like that shown in solid lines in FIG. 8. When the engagement lever 78 is in the engaged condition, corresponding to FIGS. 10 and 12, the friction block 76 is raised into direct pressing engagement against the buffer tube/second bearing interface 36, as shown in phantom lines in FIG. 8. This up and down movement of the friction block 76 is accomplished, in at least one exemplary embodiment, by an eccentric cam 80 that is carried on a shaft common with the engagement lever 78. The eccentric cam 80 is captured in operative engagement with a follower surface formed inside the friction block 76. When the engagement lever 78 is in the engaged condition, the friction block 76 presses tightly against the buffer tube/second bearing interface 36 and thereby eliminates all play/wiggle from between the handle 22 and the firing unit. The engagement lever 76 must be in the disengaged position to operate in the rapid-fire, slide-action mode. Of course, many alternative configurations of the brake feature are possible.

As is common with slide-action handles 22, the chassis 58 must include a finger rest, generally indicated at 82, which is configured to stabilize the end of a user's trigger finger 84 (FIG. 1) stretched in front of the trigger 28 of the firearm 20. In use, the user's trigger hand (e.g., the right hand for a right-handed shooter) clenches the pistol grip 66 as shown in FIG. 1 while their index fingertip 84 is extended through the trigger guard and placed upon a perch 83 of the finger rest 82. For added comfort and improved functionality, the perch 83 may be shaped with a gentle concavity to form a cradle for the user's fingertip 84.

Preferably, but not necessarily, the finger rest 82 is reversible for either left-handed or right-handed use. By way of background, a right-handed shooter wants the perch 83 to be located on the left side of the trigger 28, so that they must extend their fingertip 84 completely through the trigger guard before reaching the perch 83. Conversely, a left-handed shooter wants the perch 83 to be located on the right side of the trigger 28. By configuring the finger rest 82 to be reversible, the perch 83 can be secured into position on the left side of the firing unit for right-handed shooters or alternatively on the right side of the firing unit for left-handed shooters. There are perhaps many different ways to accomplish this general objective. One such approach is described in the afore-mentioned WO/2014078462, in which the finger rest is secured with fasteners to either the left or right sides of the handle.

In the example of this present invention, reversibility of the finger rest 82 is accomplished by configuring the chassis 58 so as to include a generally U-shaped groove 86 surrounding the first bearing slide-way 62. The U-shaped groove 86 terminates at opposing left and right notch-ends 88. The left and right notch-ends 88 are directly laterally spaced apart from one another, as perhaps best shown in FIG. 4. That is to say, the left and right notch-ends 88 are aligned to one another across the first bearing slide-way 62. The finger rest 82 is formed as a loose-piece component having a generally U-shaped, but not symmetrical, configuration. One leg of the U-shape is intentionally longer than the other leg. In this structure, the body of the finger rest 82 is adapted to seat snugly within the U-shaped groove 86 like a well-fitted strap. The perch 83 is fashioned on the longer leg of the U-shaped configuration and a concave stub 90 is fashioned on the shorter leg of the U-shaped configuration. The finger rest 82 includes a pair of internal flanges 92 that are diametrically opposed to one another inside the U-shaped band. These internal flanges 92 are perhaps best seen in FIG. 4. The internal flanges 92 are configured to engage respective left and right notch-ends 88 of the U-shaped groove 86 and thereby lock the finger rest 82 securely in place. The abutting flanges 92 and notch-ends 88 form a very strong resistance against axially rearward pressure as may be applied when a user pulls rearwardly against the perch 83 during rapid-fire, slide-action operation.

Before shouldering the firearm 20, a user inserts the finger rest 82 into the groove 86 so that the perch 83 is on the side that corresponds with their handedness—left side for right handers and right side for left handers. If the perch 83 is not on the correct side for a user, he or she merely gently spreads the legs of the U-shaped finger rest 82 sufficient for the flanges 92 to clear and disengage from the notch-ends 88. The user then removes the finger rest 82, inverts it and then re-attaches to the groove 86 where the finger rest 82 self-locks in place via the natural resiliency of the flanges 92 re-engaging against the notch-ends 88 and the U-shaped body of the finger rest 82 seated inside the groove 86. When the shooter wishes to fire the firearm 20 in normal semi-automatic mode, he or she does not place their fingertip 84 on the perch 83, but instead touches the trigger 28 directly with their fingertip 84 in a traditional shooting manner. The concave shape on the stub 90 provides both ample clearance and a comfortable tactile feel for the user's trigger finger 84 in both traditional and rapid-fire, slide-action modes of operation.

The chassis 58 is also fitted with an adjuster track, generally indicated at 94, as best shown in FIGS. 4-7. The adjuster track 94 extends longitudinally along the chassis 58, below the second bearing slide-way 72. That is, in the illustrated examples the adjuster track 94 is disposed directly below the elongated tubular channel of the second bearing slide-way 72, however in other contemplated variations the adjuster track 94 may be configured differently. In one embodiment, the adjuster track 94 is an integrally formed feature of the plastic-molded second bearing slide-way 72. In other contemplated embodiments, the adjuster track 94 is a separately manufactured element, perhaps metallic, that is attached to the bottom of the second bearing slide-way 72. The adjuster track 94 includes a plurality of notches 96 disposed at generally regular intervals therealong. In one example, there may be provided four-to-eight notches 96 spaced at intervals between about 0.75-1.25 inches. The spacing interval between notches 96 need not be regular. And of course more than eight or fewer than four notches 96 are possible. In some contemplated embodiments, there are no notches so as to provide an infinite number of stops within a defined adjustment range. The adjuster track 94 includes a pair of opposing slots 98 disposed on opposite sides of the notches 96, the purpose of which will be described subsequently.

Turning now toward discussion of the shoulder stock 60 portion of the handle 22, reference is made particularly to FIGS. 2-7. The shoulder stock 60 is operatively coupled to the chassis 58 and includes a rearwardly facing butt end 100 that is adapted to be pressed into the rear shoulder of a user, as depicted in FIG. 1. The shoulder stock 60 is adjustable, relative to the chassis 58, in order to change the trigger pull length. The trigger pull length may be defined as the distance between the butt end 100 and the trigger 28. A greater distance between butt end 100 and trigger 28 represents a longer trigger pull which is typically more comfortable for shooters having a large body frame and/or relatively long arms. And conversely, a smaller distance between butt end 100 and trigger 28 represents a shorter trigger pull which is typically more comfortable for shooters having a small body frame and/or relatively short arms and/or those wearing bulky clothing. Adjustment of the shoulder stock 60 relative to the chassis 58 is shown, for example, in FIGS. 2 and 5. The handle 22 of this invention enables a user to custom-adjust the trigger pull length to suit their preferences without affecting the ability of the firearm 22 to operate in the rapid-fire, slide-action mode. That is to say, the handle 22 enables a small framed user that prefers the shortest possible trigger pull length to operate the firearm 20 in rapid-fire, slide-action mode just as effectively as can a large framed user that prefers the longest possible trigger pull length.

In order to accomplish this adjustability between shoulder stock 60 and chassis 58, the shoulder stock 60 is provided with a pair of rails 102 that are slidably disposed in the slots 98 of the adjuster track 94. That is to say, the shoulder stock 60 slides back and forth (in the fore-and-aft direction) by way of its rails 102 rising in the slots 98 below the second bearing slideway 72. In one exemplary embodiment of this invention, the rails 102 are monolithically formed along the length of a rigid, metallic C-channel as shown in the exploded view of FIG. 4. The C-channel is fastened by screws 104 to the body of the shoulder stock 60. Of course, other C-channel attachment options are possible, as well as other overall design configurations for the rails 102.

A retractable adjuster pin 106 is disposed for movement into and out of registry with the adjuster track 94 to hold the shoulder stock 60 in a user's chosen length-adjusted position relative to the chassis 58. In the illustrated examples, the adjuster pin 106 is configured to engage a selected one of the notches in the adjuster track 94. In other contemplated examples, the adjuster pin 106, or an equivalent structure thereof, is manipulated by the user to cause the shoulder stock 60 to lock in position relative to the chassis 58 so that the rails 102 cannot slide in the slots 98. Thus, in embodiments without notches 96 (i.e., infinite adjust models), the adjuster pin 106 may be designed to provide a sufficiently strong frictional impact on the chassis 58 so as to secure the handle 22 at the user's preferred trigger pull setting. In other contemplated embodiments, the adjuster pin 106 may be configured to engage a plurality of notches 96 simultaneously, such as when the notches 96 are small and/or closely spaced from one another. Returning, however, to the specific embodiment shown in FIGS. 5-7, the adjuster pin 106 takes the form of a plunger-like member having a leading nose adapted to seat in any one of the notches 96 along the length of the adjuster track 94. An adjuster spring 108 is operatively disposed below the adjuster pin 106 and housed within a pocket formed inside the shoulder stock 60 so as to continuously urge the adjuster pin 106 upwardly, toward registry with one of the notches 96 in the adjuster track 94. Retraction of the adjuster pin 106 is accomplished by actuating a release button 110 carried on the shoulder stock 60.

Figure 6:
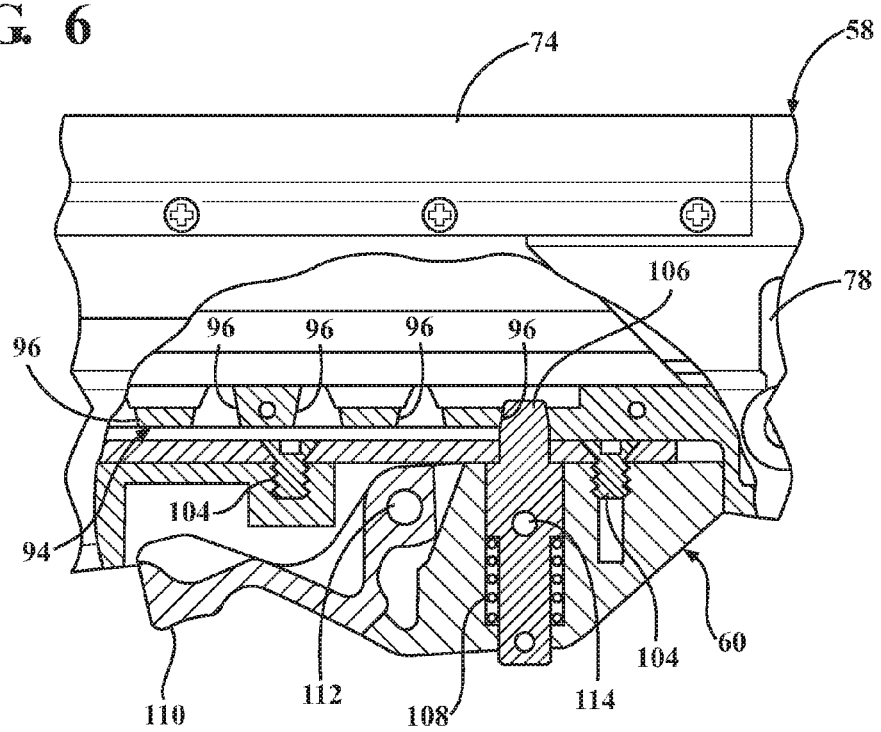
FIG. 6 is an enlarged view of the cross-sectional area of FIG. 5.
Figure 7:
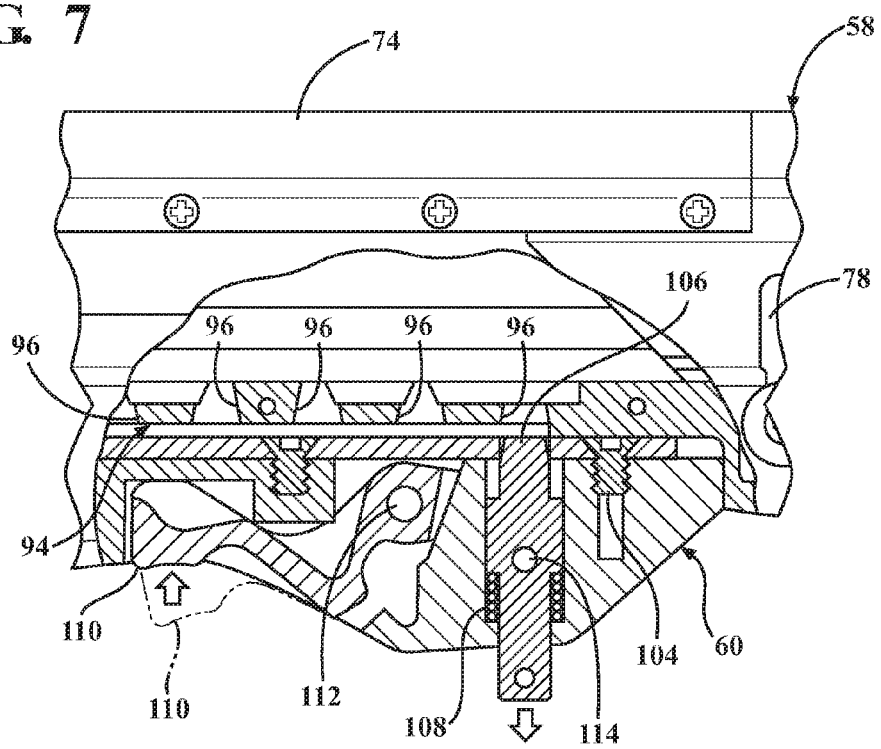
FIG. 7 is a view as in FIG. 6 but showing the release button depressed which in turn causes the nose of the adjuster pin to disengage from adjuster track and compress the adjuster spring.

There are of course many different ways to configure the release button 110. In the embodiment shown in the accompanying drawings, the release button 110 is fashioned as a lever, pivoted upon a small transverse axle 112. The adjuster pin 106 is moved out of registry with the notches 96 in the adjuster track 94 when the exposed free end of the release button 110 is depressed. The exploded view of FIG. 4 shows that the release button 110 has a forked internal end. The forked end rests atop a cross-pin 114 that extends transversely through the body of the adjuster pin 106. Pressure exerted by the adjuster spring 108 keeps the cross-pin 114 in constant contact with the forks of the release button 110. When the release button 110 is depressed by the user, its forks press downwardly on the cross-pin 114, causing the nose of the adjuster pin 106 to withdraw from the adjuster track 94 thereby enabling the shoulder stock 60 to slide back and forth relative to the chassis 58. FIG. 6 depicts the adjuster pin 106 in its normally locked position, in registry with one of the notches 96 in the adjuster track 94. FIG. 7 shows the release button 110 depressed, so as to pivot about the axle 112 and retract the nose of the adjuster pin 106 as described.

As mentioned above, there may be times when a user wants to operate the firearm 20 in a traditional, semi-automatic mode firing rounds of ammunition at a relatively slow cadence. In these situations, the user may wish to arrest all longitudinal reciprocating action between the handle 22 and the firing unit. The Applicant's own prior art, e.g., U.S. Pat. No. 8,176,835, has taught to incorporate a lock-out feature. In the present invention, a lock switch, generally indicated at 116, is provided for this purpose yet in a novel location and novel implementation. The lock-out switch 116 is engageable with the firing unit to selectively arrest relative sliding movement between the firing unit and the chassis 58 so that the user can aim and shoot from a slightly more stable platform. The afore-mentioned brake may optionally be employed during these situations to eliminate play between handle 22 and firing unit.

The lock switch 116 can take many different forms and can be implemented in many different ways. In this present example, the lock switch 116 includes a tab 118 that is moveable into and out of engagement with the lock-notch 54 in the first bearing interface 34. The tab 118 is disposed on the upper end of a shaft 120 that extends through the lock passage 70 inside the pistol grip 66. In this example, the tab 118 is shaped as a semi-cylinder, having one flat side and a curved or bulbous other side. The width of the tab 118, as measured perpendicular to its one flat face, is just slightly smaller than the width of the lock-out slot 52. Other shapes for the tab 118 are possible. A twist knob 122 is disposed on the lower end of the shaft 120, and when assembled covers the grip base 68 of the pistol grip 66 to provide a comfortable finish. Suitable retainers are used to hold the shaft 120 in the lock passage 70 with a moderate degree of friction to resist unwanted free rotation. Preferably, the outline of the twist knob 122 is symmetrical and matches the outline of the grip base 68. And furthermore, the shaft 120 preferably adjoins the twist knob 122 in its geometric center so that the twist knob 122 can be rotated about its shaft 120 and will fit flush against the grip base 68 in either of two positions—a first "locked" condition and a second "unlocked" condition that is 180-degrees offset. A torque input applied by a user to the twist knob 122 will cause the attached shaft 120 to rotate within the journal-like lock passage 70. This in turn causes the tab 118 to rotate inside the lock-out slot 52.

Figure 17:
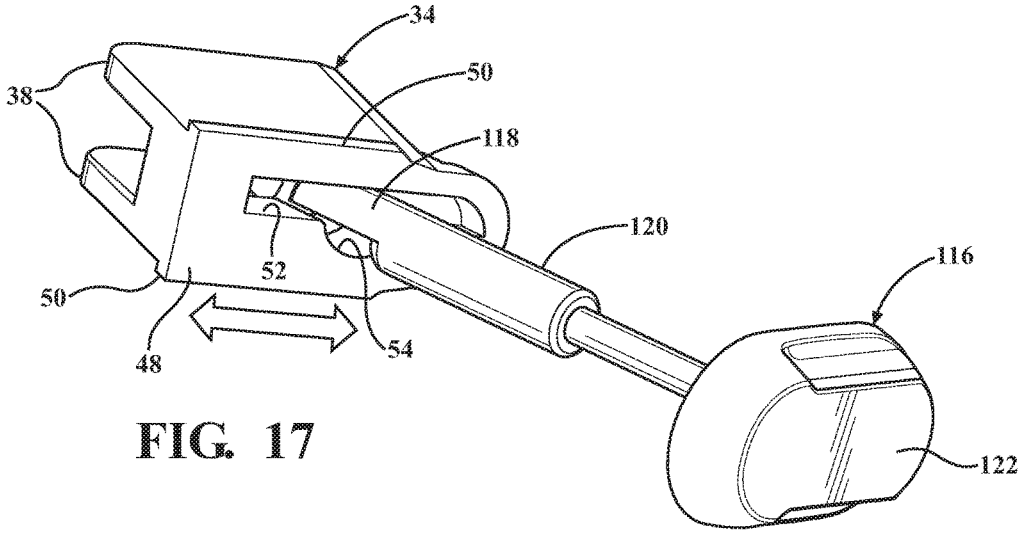
FIG. 17 is a simplified perspective view of the lock-out switch and the associated first bearing interface, where the tab of the lock-out switch is disposed in the lock-out slot of the first bearing interface.

FIG. 17 is a simplified illustration showing the twist knob 122 in its "unlocked" condition, as would be selected for rapid-fire, slide-action mode. In this state, the tab 118 is out of registry with the lock-notch 54, enabling free sliding movement of the lock-out slot 52 back-and-forth, while the tab 118 inside the lock-out slot 52 remains relatively stationary (because the user has anchored the handle 22 against their rear shoulder and the firing unit is reciprocating back-and-forth). The terminal ends of the lock-out slot 52 establish travel limits for the chassis 58. That is to say, when the tab 118 reaches the end of the lock-out slot 52, the handle 22 will not slide any further relative to the firing unit. In this manner, the tab 118 and slot 52 arrangement provides an over-travel limiting function. When it is desired to the disconnect the handle 22 from the firing unit, the user must pull downwardly on the twist knob 122 (against a biasing spring—not shown), causing the tab 118 to withdraw from the lock-out slot 52. Once the tab 188 is sufficiently withdrawn from the lock-out slot 52, the handle 22 can be removed from the firing unit. Re-assembly is accomplished by reversing these steps.

Figure 18:
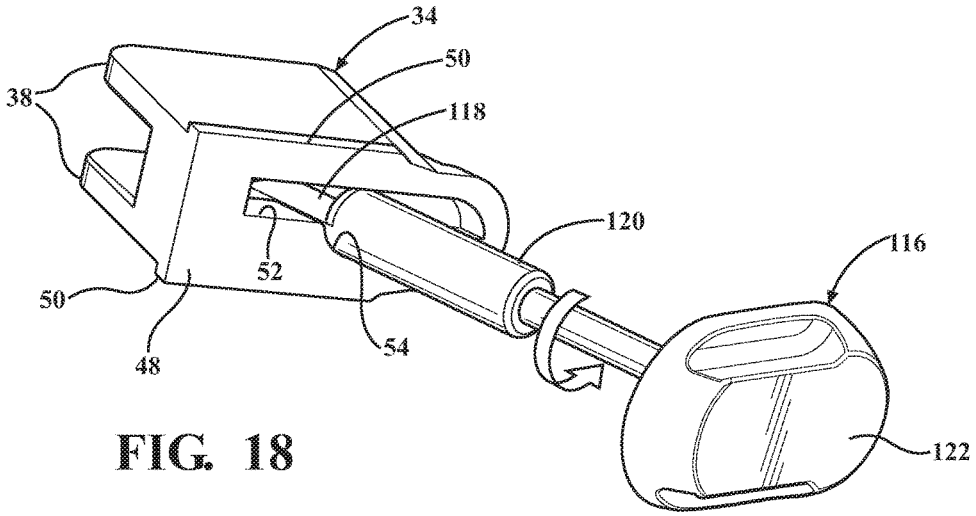
FIG. 18 is a view as in FIG. 17 but showing the lock-out switch rotated 180-degrees so that its tab becomes trapped in the lock-notch portion of the lock-out slot.

For traditional, semi-automatic firing mode, the user will rotate the twist knob 122 180-degrees to the "locked" condition shown in FIG. 18. This can only be accomplished when the handle 22 is fully compressed against the firing unit, because the lock-notch 54 is intentionally located at this corresponding position along the length of the lock-out slot 52. When the handle 22 is fully compressed relative to the trigger, the tab 118 is aligned with the lock-notch 54 such that 180-degree rotation cause the bulbous portion of the tab 118 to roll into the complimentary lock-notch 54. This effectively secures the tab 118 relative to the first bearing interface 34. And because the tab 118 is held fast inside the lock passage 70, the entire handle 22 is locked in the fully collapsed position relative to the firing unit.

The lock-out switch 116 is adaptable across a wide range of firearm types, and is particularly attractive in handgun applications. It is also worth mentioning again that many variants of the tab 118 and lock-notch 54 interaction are contemplated. The lock-notch 54 could be configured as a feature of the first bearing interface 34 wholly disassociated from any type of lock-out slot 52, so that the tab 118 interacts with just the lock-notch 54. For example, the lock-notch 54 could be designed as a protruding feature on the first bearing interface 34, such as a bump or a stub, with the tab 116 selectively interacting therewith to accomplish over-travel limits as well as the lock-out condition desired for traditional, semi-automatic firing mode.

The foregoing invention has been described in accordance with the relevant legal standards, thus the description is exemplary rather than limiting in nature. Variations and modifications to the disclosed embodiment may become apparent to those skilled in the art and fall within the scope of the invention. Furthermore, particular features of one embodiment can replace corresponding features in another embodiment or can supplement other embodiments unless otherwise indicated by the drawings or this specification.

What is claimed is:

1. A manually-actuated slide-action stock assembly for a semi-automatic firearm of the type having a firing unit comprised of a barrel and a receiver and a finger-actuated trigger, said assembly comprising:

a slide-action handle configured for slideable attachment to the firing unit of a semi-automatic firearm so that the firing unit longitudinally reciprocates within said handle when in a rapid-fire mode of operation, said handle having a right side and a left side corresponding to the right and left anatomical sides of a human user when said assembly is held for operation, said handle including a finger rest configured to stabilize a user's trigger finger stretched in front of the trigger, said finger rest having a generally U-shaped configuration comprising a longer leg and a shorter leg, a finger cradle on said long leg and a stub on said shorter leg, said finger rest wrapping around said handle so that said longer leg is disposed toward one of said right and left sides of said handle and said shorter leg is disposed toward the other of said right and left sides of said handle, said finger rest being supported on said handle for selective placement in either a right-handed position or an inverted left-handed position, wherein in said right-handed position said finger cradle is oriented toward said left side of said handle and in said left-handed position said finger cradle is re-oriented toward said right side of said handle.

2. The assembly of claim 1, wherein said finger cradle on said longer leg of said U-shaped configuration is concave and said stub on said shorter leg of said U-shaped configuration is concave.

3. The assembly of claim 2, wherein said handle includes a first bearing slide-way, a U-shaped groove surrounding said first bearing slide-way, said finger rest at least partially disposed in said U-shaped groove.

4. The assembly of claim 3, wherein said U-shaped groove terminates at opposing left and right notch-ends, said left and right notch-ends being directly laterally spaced apart from one another on opposite sides of said first bearing slideway, said finger rest including a pair of internal flanges diametrically opposing one another and each configured to engage a respective one of said left and right notch-ends.

5. The assembly of claim 1, further including a first bearing interface adapted for connection to a firing unit, a lock switch engageable with said first bearing interface to selectively arrest relative sliding movement between the firing unit and said handle.

6. The assembly of claim 5, wherein said handle includes a first bearing slide-way disposed in sliding connection with said first bearing interface, a pistol grip extending downwardly from said first bearing slideway, a lock passage extending through said pistol grip and into said first bearing slide-way, said first bearing interface including a lock-notch, said lock switch including a tab moveable into and out of engagement with said lock-notch in said first bearing interface, said tab disposed on the upper end of a shaft extending through said lock passage in said pistol grip, a twist knob disposed on the lower end of said shaft for receiving a torque input to rotate said tab into and out of engagement with said lock-notch.

7. The assembly of claim 1, further including a second bearing interface adapted for connection to a firing unit, said handle including a second bearing slide-way disposed in sliding connection with said second bearing interface, a brake disposed for movement between extended and retracted positions within said second bearing slide-way, said brake having a generally v-shaped friction block, an engagement lever operatively connected to said friction block for selectively moving said friction block between a disengaged condition to an engaged condition.

8. The assembly of claim 1, wherein said handle includes a chassis portion and a shoulder stock portion, an adjuster track extending longitudinally along said chassis, said shoulder stock including an adjuster pin disposed for movement into and out of registry with said adjuster track.

9. The assembly of claim 8, wherein said adjuster track includes a plurality of notches disposed at generally regular intervals therealong, said adjuster pin configured to engage a selected one of said notches in said adjuster track to fix said shoulder stock in a length-adjusted position relative to said chassis, a release button carried on said shoulder stock, said release button actuatable to move said adjuster pin out of registry with said notches in said adjuster track.

10. A slide-action stock assembly for a semi-automatic firearm having a longitudinally reciprocating firing unit comprised of a barrel and a receiver and a finger-actuated trigger, said assembly comprising:

a first bearing interface adapted for connection directly behind the trigger of a semi-automatic firing unit, a slide-action handle, said handle including a first bearing slide-way disposed in sliding connection with said first bearing interface for longitudinally reciprocating movement when in a rapid-fire slide-action mode of operation, said handle including a pistol grip extending downwardly from said first bearing slide-way at an oblique back-angle, a finger rest configured to stabilize a user's trigger finger stretched in front of the trigger of the firearm, and a lock switch supported directly on said pistol grip, said lock switch engageable with said first bearing interface to selectively arrest relative sliding movement between the firing unit and said handle.

11. The assembly of claim 10, wherein said first bearing interface has a bottom portion, a lock-out slot disposed in said bottom portion of said first bearing interface, said lockout slot having a lock-notch, said lock switch including a tab moveable into and out of engagement with said lock-notch.

12. The assembly of claim 11, further including a lock passage extending through said pistol grip and into said first bearing slide-way, said tab disposed on the upper end of a shaft extending through said lock passage in said pistol grip, a twist knob disposed on the lower end of said shaft for receiving a torque input to rotate said tab into and out of engagement with said lock-notch.

13. The assembly of claim 10, further including a second bearing interface adapted for connection to a firing unit, said handle including a second bearing slide-way disposed in sliding connection with said second bearing interface, a brake disposed for movement between extended and retracted positions within said second bearing slide-way, said brake having a generally v-shaped friction block, an engagement lever operatively connected to said friction block for selectively moving said friction block between a disengaged condition to an engaged condition.

14. The assembly of claim 10, wherein said handle includes a chassis portion and a shoulder stock portion, an adjuster track extending longitudinally along said chassis, said shoulder stock including an adjuster pin disposed for movement into and out of registry with said adjuster track.

15. The assembly of claim 14, wherein said adjuster track includes a plurality of notches disposed at generally regular intervals therealong, said adjuster pin configured to engage a selected one of said notches in said adjuster track to fix said shoulder stock in a length-adjusted position relative to said chassis, a release button carried on said shoulder stock, said release button actuatable to move said adjuster pin out of registry with said notches in said adjuster track.

16. The assembly of claim 10, wherein said finger rest is detachable from said pistol grip and has a generally U-shaped configuration adapted to connect to said handle in either a right-handed position or an inverted left-handed position.

17. The assembly of claim 16, wherein said finger rest includes a concave finger cradle on a longer leg of said U-shaped configuration and a concave stub on a shorter leg of said U-shaped configuration.

18. The assembly of claim 17, wherein said handle includes a U-shaped groove surrounding said first bearing slide-way, said finger rest at least partially disposed in said U-shaped groove, said U-shaped groove terminating at opposing left and right notch-ends, said left and right notch-ends being directly laterally spaced apart from one another on opposite sides of said first bearing slideway, said finger rest including a pair of internal flanges diametrically opposing one another and each configured to engage a respective one of said left and right notch-ends.

19. A slide-action stock assembly for a semi-automatic firearm having a longitudinally reciprocating firing unit, said assembly comprising:

a first bearing interface adapted for connection directly behind the trigger of a semi-automatic firing unit, a second bearing interface adapted for connection to a firing unit and spaced apart from said first bearing interface, a slide-action handle, said handle including a first bearing slide-way disposed in sliding connection with said first bearing interface for longitudinally reciprocating movement when in a rapid-fire slide-action mode of operation, said handle including a second bearing slide-way disposed in sliding connection with said second bearing interface, a finger rest configured to stabilize the end of a user's trigger finger stretched in front of the trigger of the firearm, and a brake disposed for movement between extended and retracted positions within said second bearing slideway, said brake having a generally v-shaped friction block, an engagement lever operatively connected to said friction block for selectively moving said friction block between a disengaged condition and an engaged condition.

20. The assembly of claim 19, wherein said handle includes a chassis portion and a shoulder stock portion, an adjuster track extending longitudinally along said chassis, said shoulder stock including an adjuster pin disposed for movement into and out of registry with said adjuster track.

* * * * *